US006805065B1

(12) United States Patent
Reynolds

(10) Patent No.: US 6,805,065 B1
(45) Date of Patent: Oct. 19, 2004

(54) SYSTEM AND METHOD FOR REDUCING OR ELIMINATING SAILBOAT HEELING

(76) Inventor: Peter Frederick Reynolds, 45368 Lakeshore Homes Rd., Loon Lake, WA (US) 99148

( * ) Notice: Subject to any disclaimer, the term of this patent is extended or adjusted under 35 U.S.C. 154(b) by 0 days.

(21) Appl. No.: 10/705,006

(22) Filed: Nov. 10, 2003

(51) Int. Cl.[7] ..... B63B 15/00
(52) U.S. Cl. ..... 114/91; 114/93
(58) Field of Search ..... 114/39.12, 90, 114/91, 93

(56) References Cited

U.S. PATENT DOCUMENTS 3,802,371 A * 4/1974 Jastrab ..... 114/39.29
5,134,952 A * 8/1992 Doolittle ..... 114/39.12
5,337,691 A * 8/1994 Borcherdt ..... 114/93
5,490,472 A * 2/1996 Hulse et al. ..... 114/90
5,823,129 A * 10/1998 Barnes, Jr. ..... 114/39.16

* cited by examiner

*Primary Examiner*—Stephen Avila

(57) ABSTRACT

A system and method for reducing or eliminating heeling in sailboats of any hull design by allowing the mast and sail assembly to heel in a significant wind while the hull remains flat relative to the water. This system and method requires a mast able to rotate 360 degrees making it easy to dump wind when under sail and when docking and mooring. This allows the deck of a sailboat to be uncluttered by mast stays, sheets and halyards requiring only a single sheet to control point of sail. By reducing or eliminating heeling, this sailing system and method increases safety compared to traditional systems and makes it easier to learn to sail.

14 Claims, 9 Drawing Sheets

SYSTEM AND METHOD FOR REDUCING OR ELIMINATING SAILBOAT HEELING

CROSS-REFERENCE TO RELATED APPLICATIONS

Not Applicable

BACKGROUND OF THE INVENTION

1. Field of the Invention

The invention relates to an innovative system that attaches the mast of a sailboat to the hull in such a way that the mast tips in the wind independently of the hull, allowing the hull to remain flat relative to the water thus reducing or eliminating capsizing due to accident or lack of sailing experience.

2. Description of the Related Art

In a traditional sailing system, the mast is rigidly fixed to the boat at a 90 degree angle to the deck. Cables or stays from the mast to the deck are used to maintain this rigidity. A boom is fixed to the mast at a swivel point allowing it to swing left and right aft of the of the mast. The boom is controlled with a set of lines that run from it to the deck. The sail is then stretched between the mast and the boom and the swing of the boom is used to adjust the sail to the optimum angle for wind power. Because the mast is rigidly fixed to the hull, a stiff breeze from any of many different angles will place sufficient wind pressure on the sail and mast to cause the entire boat to heel over or tip in the wind. The deck remains fixed at 90 degrees to the mast, but changes its angle relative to the water, often drastically.

The traditional design also significantly limits the process of "dumping wind," loosening the sail to reduce its resistance to the wind and thus reducing the heel of the hull and the speed of the boat, because the mast stays limit the ability to swing the sail away from the wind. The stays limit the swing of the boom to 180 degrees at best. When docking a traditionally rigged sailboat, this limitation means that when the wind is coming from behind the boat, the sails must be dropped or furled to kill the power of the wind and stop the forward motion of the boat. This can be especially tricky for the novice sailor and, when the wind is strong, it can become difficult or even hazardous for the experienced sailor.

Even in those boat designs that have rotating masts, the masts are placed in tubes that are fixed to the boats at 90 degree angles to the decks. Such masts rely on the strength of the material from which the masts are made (e.g. carbon fiber) to support the sails. As soon as the tensile limits of the masts are reached, this type of boat heels or tips in the wind just as a stayed mast boat does. These designs are limited in hull and sail size.

In boats with current rotating mast and boom designs, the booms are low and parallel to the deck creating a danger to crew when they swing across the deck.

For a small sailboat that does not have a weighted centerboard or keel for stability, the consequence of these traditional designs is that the boat heels significantly in even light to moderate winds. Small boat sailors expect "knockdowns" or capsizing due to unexpected wind gusts or as a result of their inexperience. They expect to spend time learning to manage complex rigging, and they expect to spend time furling and otherwise managing sail. Even in larger boats of weighted keel or weighted drop keel design, the traditional fixed mast design creates the need for the hull to heel in a strong wind, and creates the safety and manageability problems caused by traditional complexity.

BRIEF SUMMARY OF THE INVENTION

The object of the present invention is to provide a system for sailboats of any hull design that allows the mast to tilt in the wind while the deck stays flat relative to the water. The invention significantly simplifies mast and boom rigging. It significantly simplifies sail management. The only line to the deck is a sheet from the end of the boom that establishes point of sail. The sailor need only release this sheet to allow the sail to turn completely away from the wind increasing safety in high winds and simplifying docking or mooring.

The system consists of four elements in most embodiments:

1. A self-righting mast assembly that attaches the mast to the hull and consists of:
   a) a housing that is attached to the hull,
   b) a mast support tube in which the mast is inserted rests on a pivot point in the housing,
   c) a system of tensioners that both attach the mast support tube to the housing and allow the mast to lean in the wind independently of the hull to the tensioners limit,
   d) a tension adjusting mechanism that increases or decreases the resistance of the tensioners.
2. A self-stayed mast assembly that is able to rotate 360 degrees in the mast support tube and tilt in all directions in the wind. The self-stayed mast is sufficiently strong to heel in the wind and, at the same time, propel the boat forward. The strength of the mast comes from 2 elements: a cable bridging system that offsets pressure to one side of the mast with a cable bridge on the other, and a mast reinforcing bar, rotational wear assembly that strengthens the mast from above the lower cable attaching points to the pivot point at the bottom of the mast.
3. A floating wishbone boom that is attached to the mast by a system of pulleys and cleats and thus does not require lines attaching it to the deck. Such a boom design allows the boom to rotate and lean with the mast independent of the deck. It allows a simplified boom and sail stowage system.
4. A sail design that includes the boom vang, the line that runs from the boom to the mast, in a sleeve attached to the bottom of the sail. Such a sail design allows the floating boom attached to the integrated boom vang to become the outhaul and spread the sail by pushing the entire assembly away from the mast.

DETAILED DESCRIPTION OF THE INVENTION

Figure 1:
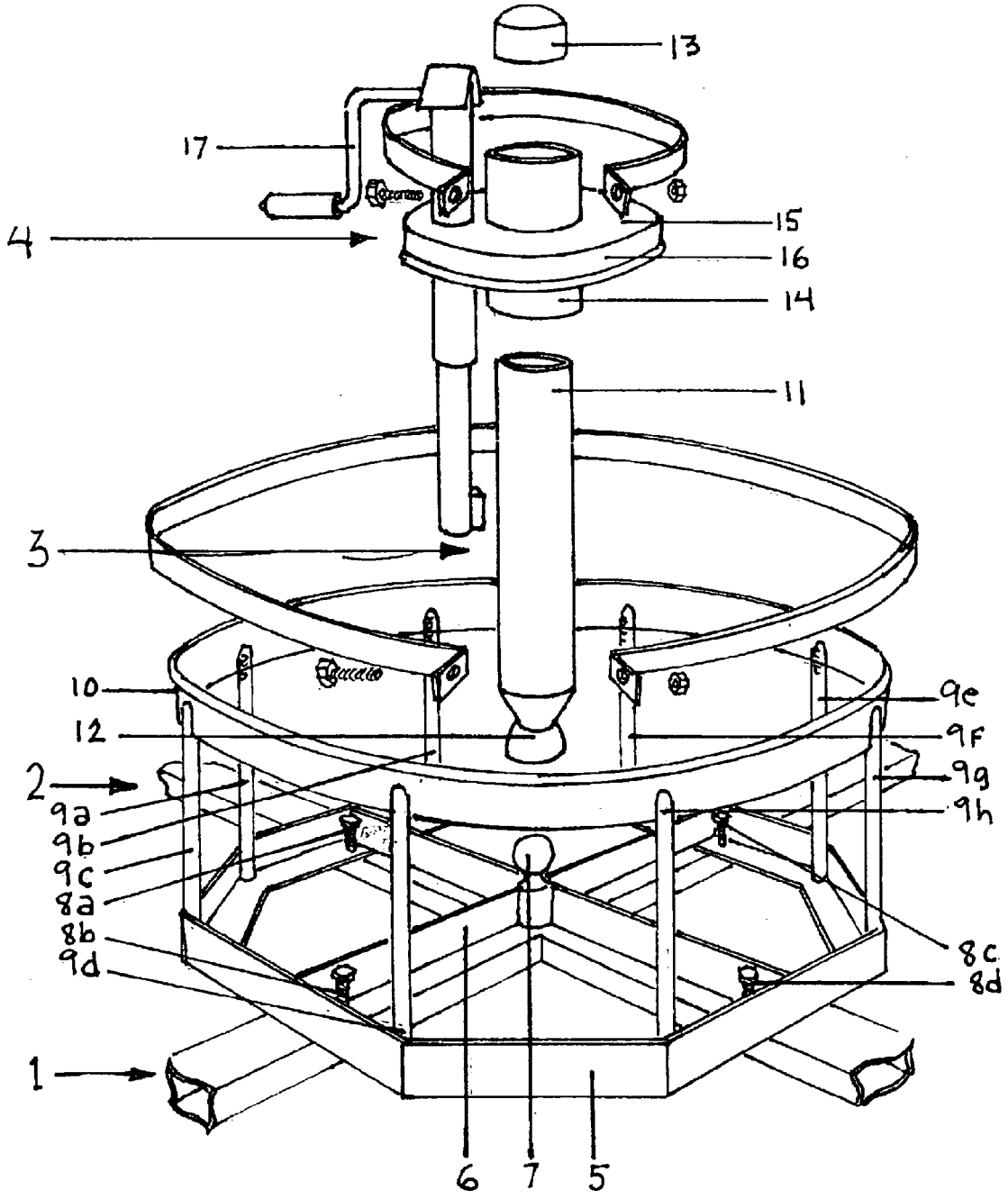
FIG. 1: a partial perspective view of the preferred embodiment of a self-righting mast system consisting of a support cross member, a housing, a mast support tube and a tension jack.

FIG. 1 Shows the above deck preferred embodiment of a self-righting mast system in which the self-righting mast system housing 2 is bolted with attaching bolts 8(*a,b,c,d*) to a support cross member 1 that is an integral part of a sailboat's deck The self-righting mast system housing base 5 is an octagonal ring of 90 degree angled metal. The bolts 8(*a,b,c,d*) go through the horizontal flange of the housing base 5 into the support cross member 1. The housing base 5 contains a cross base brace 6. Attached at the center of the cross base brace is the mast support tube pivot ball 7. It is upon this pivot ball 7 that the mast will tilt in all directions.

The housing base 5 is attached to the lower housing boot retainer ring 10 by a series of base/ring connectors 9(*a,b,c,d,e,f,g,h*).

A mast support tube 11 with a pivot ball socket 12 rests on the pivot ball 7. A mast thrust wear button 13 is placed in the bottom of the mast support tube 11 just above the pivot ball socket 12. The mast is inserted into the tube 11 and rests on the mast thrust wear button 13.

A boot tensioning tube 14 is fixed in the center of the boot tensioning plate 15. The boot tensioning tube 14 has an inside diameter that is equal to the outside diameter of the mast support tube 11 so that it can slide on the mast support tube. Fixed around the boot tensioning plate 15 is the upper boot housing retainer ring 16.

Also attached to the boot tensioning plate 15 is the top of a tensioning jack 17. The bottom of the tensioning jack is fixed to the side of the mast support tube 11. When the boot tensioning tube 14 is slid over the mast support tube 11 and the tensioning boot 18 or shock cords are in place (FIG. 2), then the tensioning jack 17 can raise or lower the boot tensioning plate 15.

Figure 2:
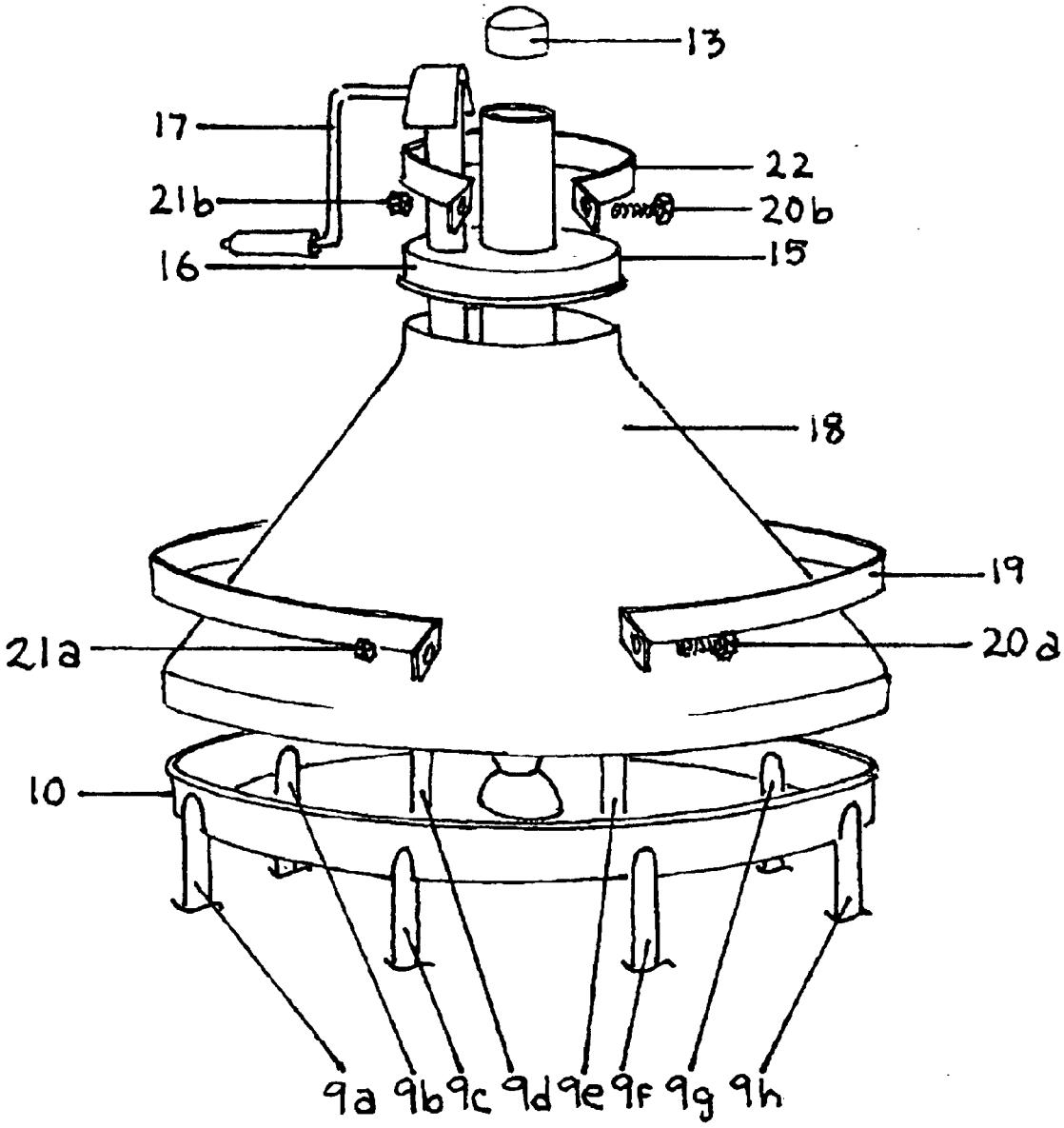
FIG. 2: a perspective view of the preferred embodiment of the self-righting mast system in FIG. 1 with an elastic tensioning boot.

FIG. 2 shows a perspective view of the preferred embodiment of the self-righting mast system in FIG. 1 with an elastic tensioning boot 18 installed.

The tensioning boot 18 is an elastic sleeve that is attached at the top to the upper housing boot retainer ring 16 by the upper clamp 22 and a bolt 20*b* and nut 21*b*. The tensioning boot 18 is attached at the bottom to the lower housing boot retainer ring 10 by the lower clamp 19 and a bolt 20*a* and nut 21*a*.

Using the tensioning jack 17 to raise the boot retainer ring 16 and the tensioning plate 15 places more tension on the boot and increases the resistance of the boot 18 to the tipping of the mast support tube FIG. 1, 11 on the ball FIG. 1, 7 and socket FIG. 1, 12 when the mast it contains is under wind pressure. Using the tensioning jack 17 to lower the tensioning plate 15 reduces the tension and decreases the resistance of the boot 18 to the mast support tube FIG. 1, 11 when it tips under mast pressure. This allows the sailor to adjust his sail's resistance to the wind by adjusting the tension on the tensioning boot 18.

Figure 3:
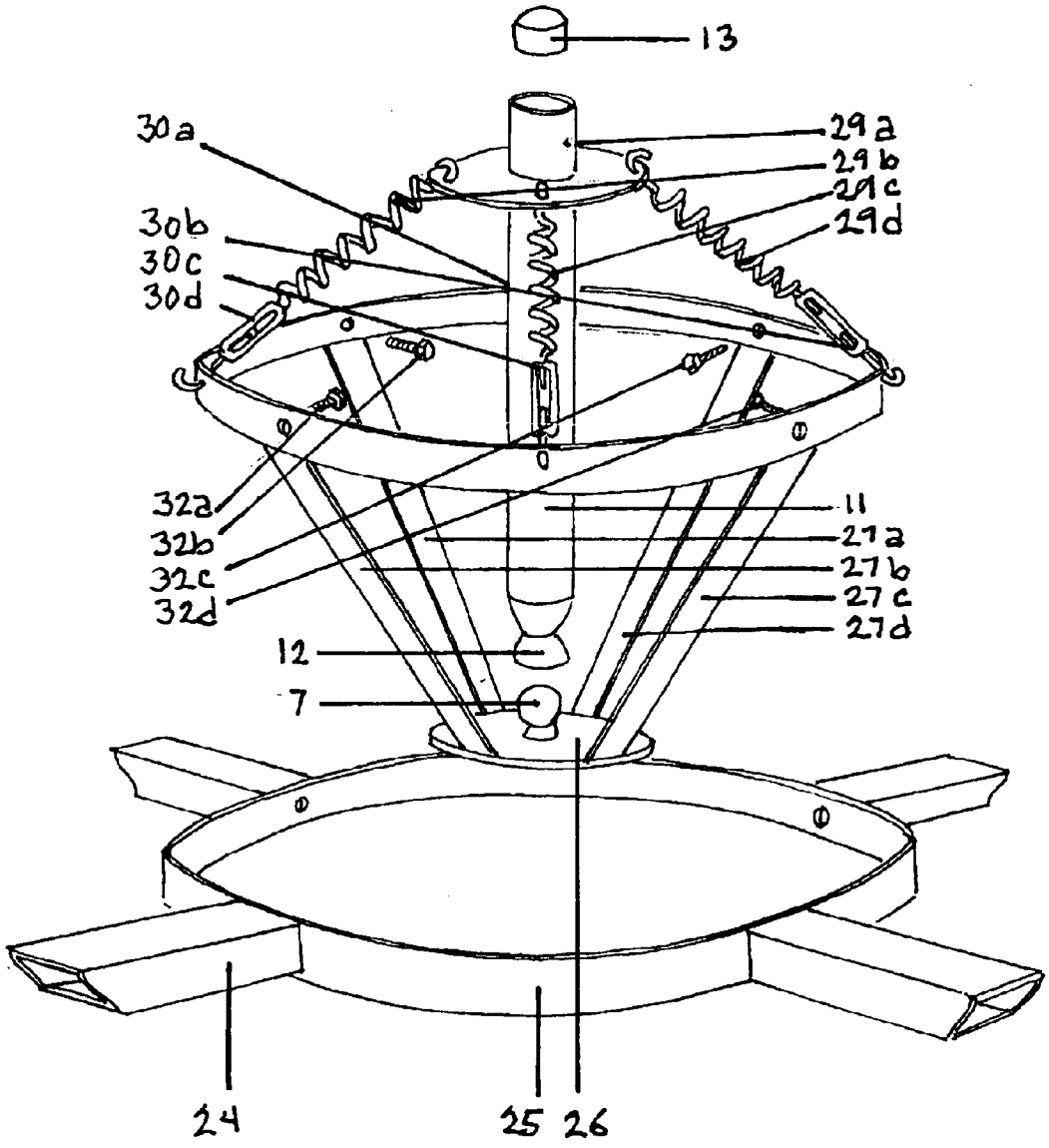
FIG. 3: a perspective view of an alternate low aspect or below deck embodiment of the self-righting mast system with spring tensioners.

FIG. 3 shows an alternative low aspect or partial below deck embodiment of the self-righting mast system. In this embodiment, the support cross member 1 of the above deck embodiment shown in FIG. 1 is modified FIG. 3, 24 by placing a cross member housing retainer ring 25 at its center. The housing tensioning retainer ring 28 is fixed to the cross member housing retainer ring 25 with bolts 32(*a,b,c,d*).

Mounting plate supports 27(*a,b,c,d*) extend below the deck and attach to the pivot ball mounting plate 26. The mast support tube pivot ball 7 is fixed at the center of the pivot ball mounting plate 26. The mast support tube 11 with the pivot ball socket 12 at its bottom rests on the pivot ball 7.

The mast support tube 11 is attached to tensioning retainer plate 31 at its top. Instead of the elastic tensioning boot 18, this embodiment uses springs 29(*a,b,c,d*) as the tensioning devise. Instead of the tensioning jack FIG. 1, 17 of the preferred embodiment, tensioning turn buckles 30(*a,b,c,d*) adjust the resistance of the self-righting mast system to the tipping sail.

Placing the pivot point 7 of the system below the deck does not change the action of the self-righting mast system at all. The mast will still tilt in the wind to the extent that the resistance of the tensioning springs 29(*a,b,c,d*) and the diameter of the housing tensioning retainer ring 28 will allow.

Figure 4:
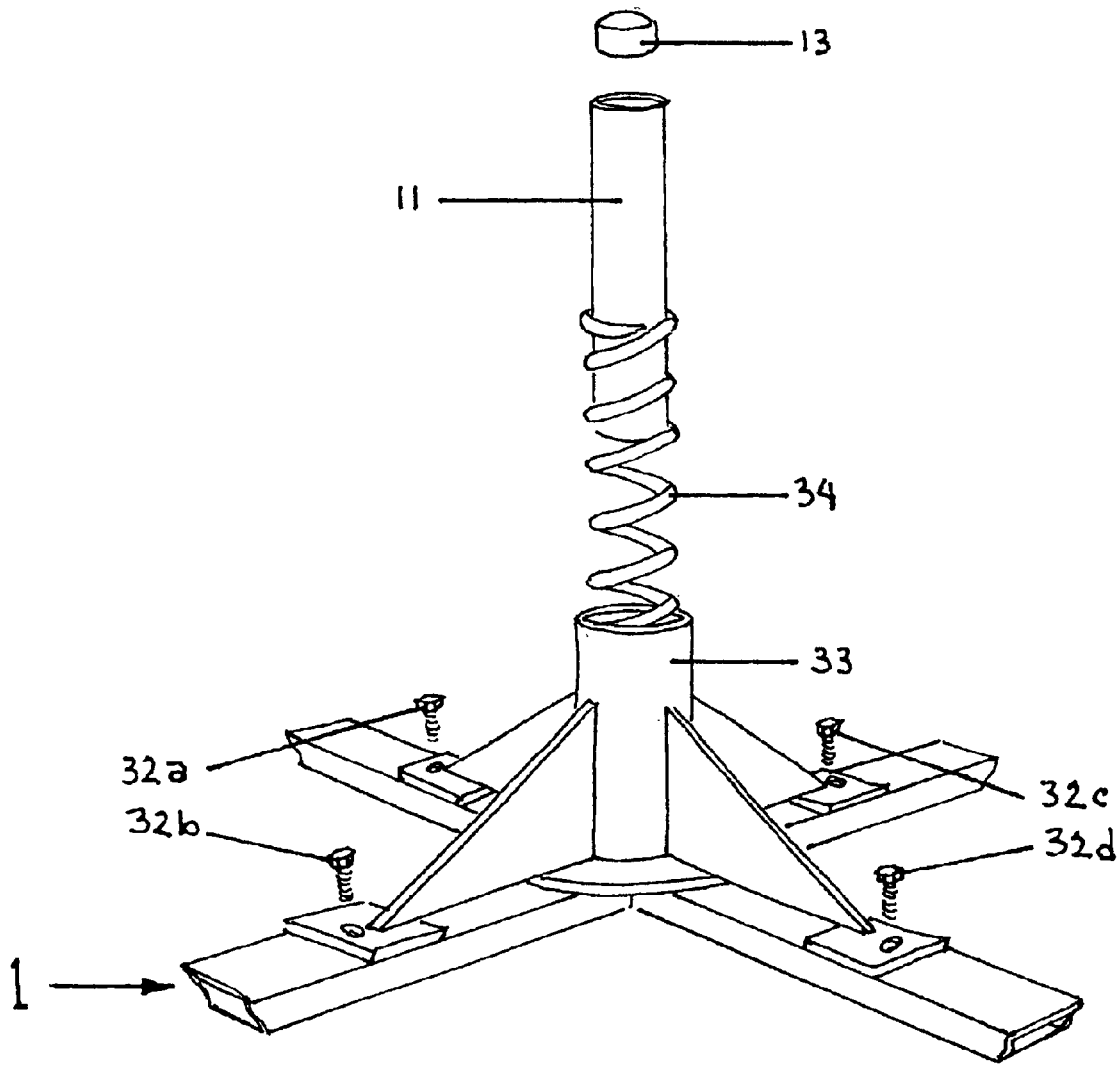
FIG. 4: a perspective view of an alternate single spring embodiment of the self-righting mast system.

FIG. 4 shows a second alternative embodiment of the self-righting mast system, the single spring self-righting mast assembly. In this embodiment, a heavy mast support spring 34 with an inside diameter that is the same as the outside diameter of the mast support tube 11 is attached to a single spring mount 33 that is bolted to the self-stayed mast support system cross member 1 with bolts 32(*a,b,c,d*).

Figure 5:
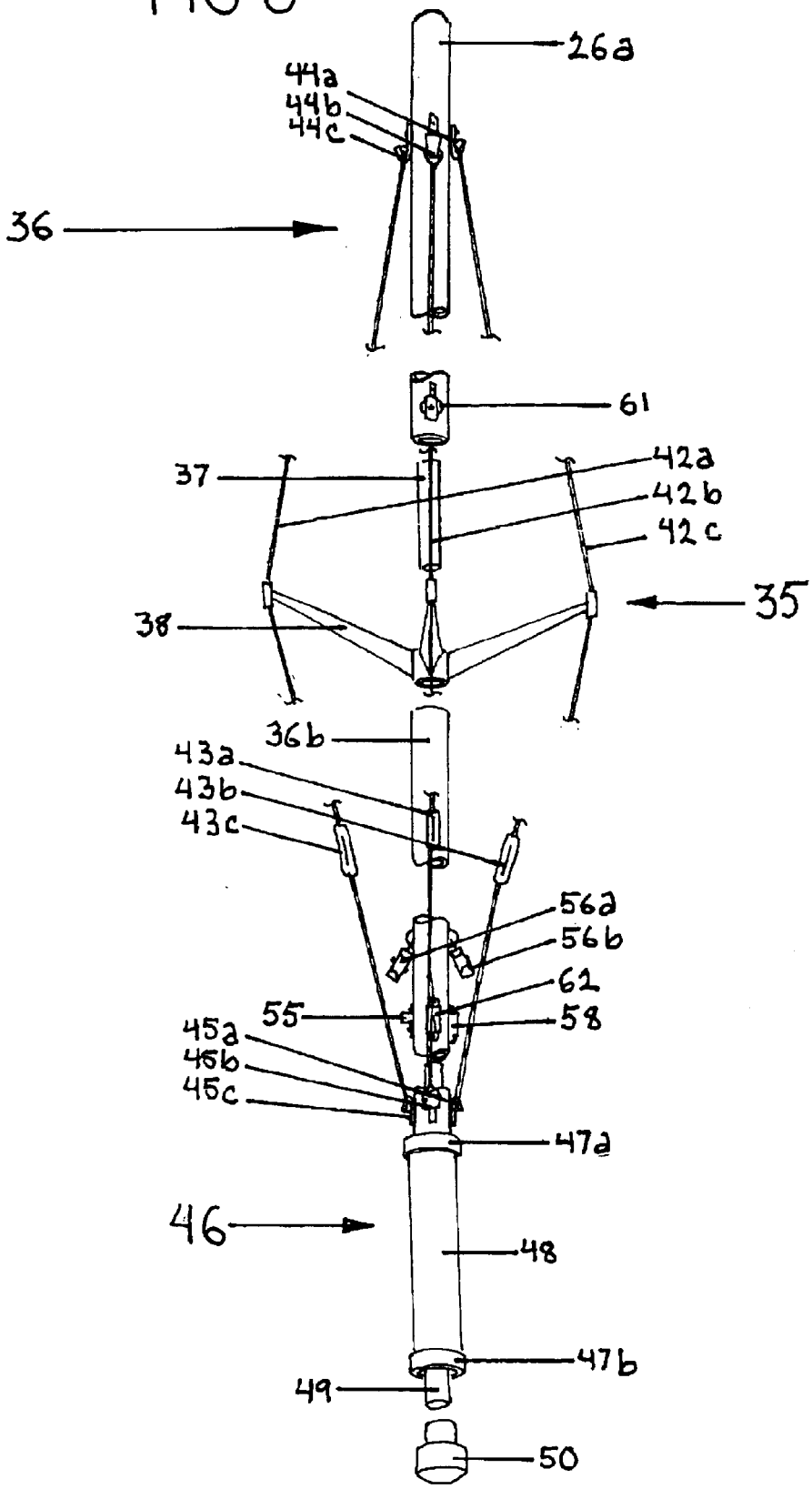
FIG. 5: a perspective view of a partial view of a self-stayed mast system.

The mast support tube 11 is then attached inside the upper portion of the mast support spring 34. When the self-stayed mast FIG. 5, 35 is dropped into the mast support tube, it is free to turn a full 360 degrees and to tilt in all directions in the wind. Note, however, that this embodiment does not allow the tension of the system to be adjusted to wind conditions and sailor experience.

FIG. 5 shows the mast bridging system 35 that creates the self-stayed mast necessary for this system to eliminate sailboat heeling. The hollow mast assembly 36 is split half way down its length. A cable spreader splice 37 with an outside diameter equal to the inside diameter of the mast is attached to the bottom portion of the mast 36*b*.

Figure 6:
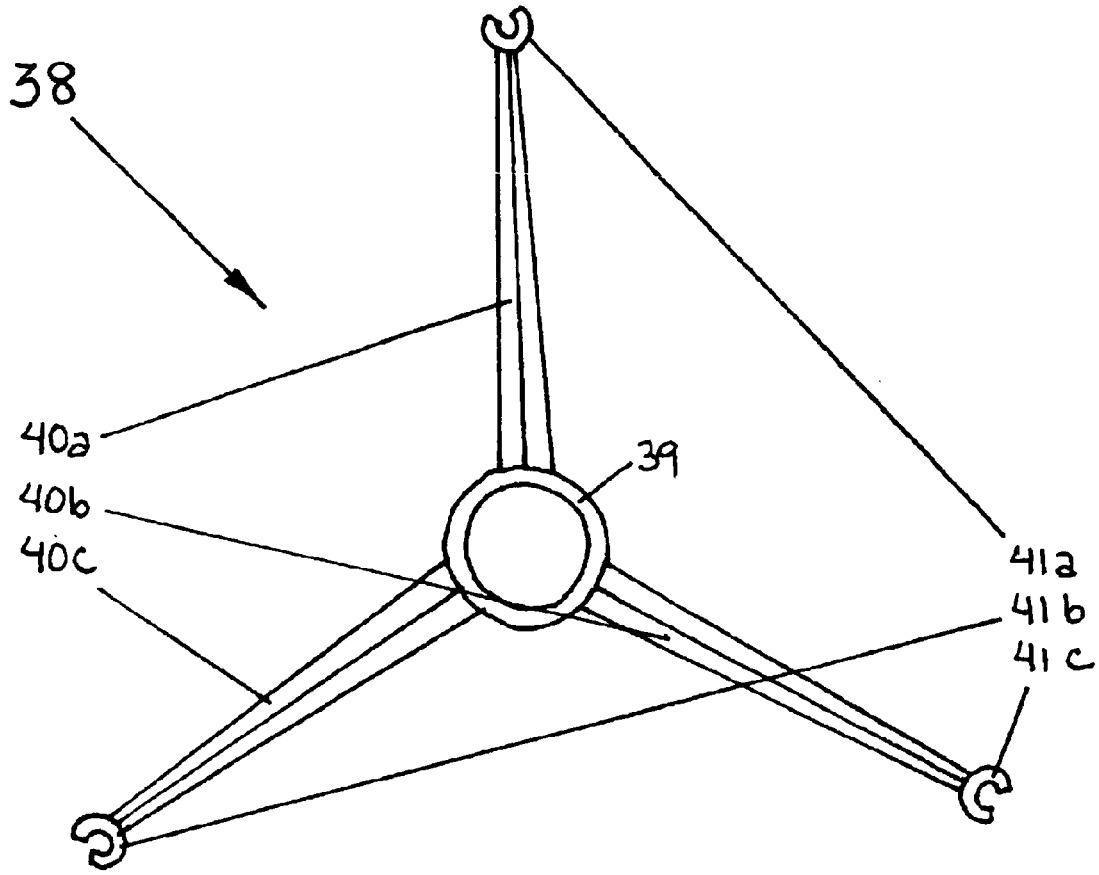
FIG. 6: a top view of a three way cable spreader

FIG. 6 shows the three way cable spreader 38 that has a hub 39 with an inside diameter that is equal to the outside diameter of the the cable spreader splice FIG. 5, 37. The outside diameter of the hub 39 is equal to the diameter of the mast segment FIG. 5, 36*b*.

FIG 5 also shows that the three way cable spreader 38 slides over the cable spreader splice 37 and rests on the lower half of the split mast 36*b*. The three way cable spreader 38 is free to rotate on the cable spreader splice 37. The upper portion of the split mast 36*a* slides over the cable spreader splice 38 to complete the mast.

FIG. 5 also shows the three top cable attaching points 44(*a,b,c*) and the three bottom cable attaching points 45(*a,b,c*). The cable attaching points are attached to the mast with one at the front of the mast and the other two at 120 degrees in each direction around the mast from the first The cables 42(*a,b,c*) are attached to the top cable attaching points 44(*a,b,c*) and threaded through the cable guides FIG. 6, 41(*a,b,c*) in the three way cable spreader 38. They are then attached to the bottom cable attaching points 45(*a,b,c*). Cable spreader turnbuckles 43(*a,b,c*) are added to the cables 42(*a,b,c*) toward the bottom of the system to allow the cables to be tightened.

Figure 7:
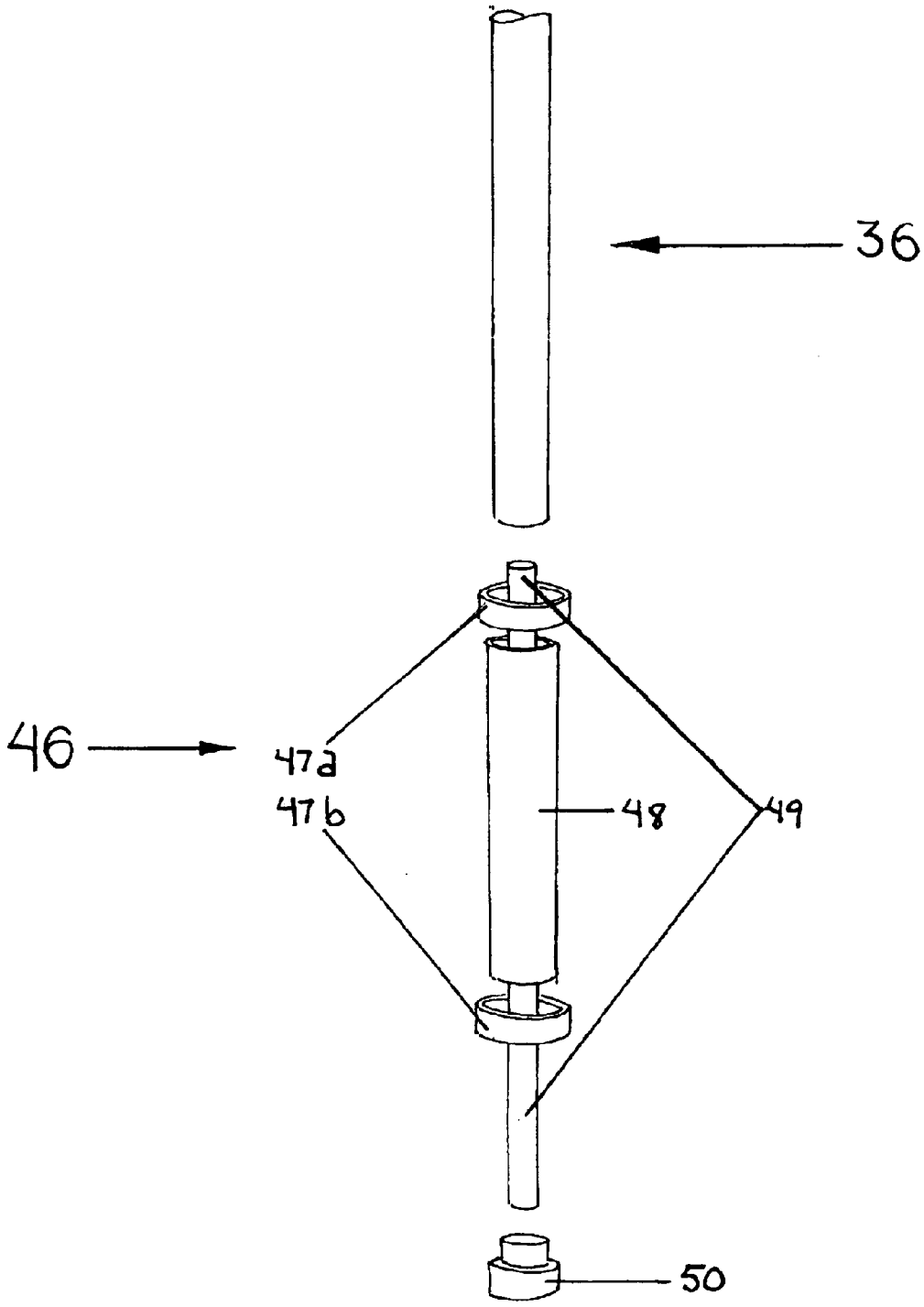
FIG. 7: a perspective view of a mast stiffening and wear assembly

FIG. 6 shows a top view of the three way cable spreader 38 that consists of a hub 39 that has an inside diameter that is equal to the outside diameter of the the cable spreader splice FIG. 5, 37. The outside diameter of the hub 39 is equal to the diameter of the mast segment FIG. 5, 36*b*. The three way cable spreader 38 has three arms 40(*a,b,c*) that are attached to the hub 120 degrees apart. At the end of each arm 40(*a,b,c*) is a cable guide 41(*a,b,c*) through which the cables FIG. 5, 42(*a,b,c*) are threaded FIG. 7 shows the mast wear and stiffening assembly 46 that reinforces the bottom portion of the mast 36. It consists of a mast reenforcing bar 49 that has an outside diameter equal to the inside diameter of the mast 36. This mast reenforcing bar 49 is attached inside the mast 36 and extends from the bottom of the mast to a point above the bottom cable connecting points FIG. 5, 45(*a,b,c*).

A mast wear tube 48 with an inside diameter equal to the outside diameter of the mast 36 is fixed to the outside of the mast 36. Fixed at the top and bottom of the mast wear tube are wear tube collars 47*a* and 47*b* that are the only part of the assembly that make contact with the mast support tube FIG. 1, 11. At the bottom of the mast segment FIG. 5, 36*b* a mast wear plate 50 is fixed. This mast wear plate 50 rests upon the mast thrust wear button FIG. 1, 13 and is the point on which mast assembly 36 rotates.

Figure 8:
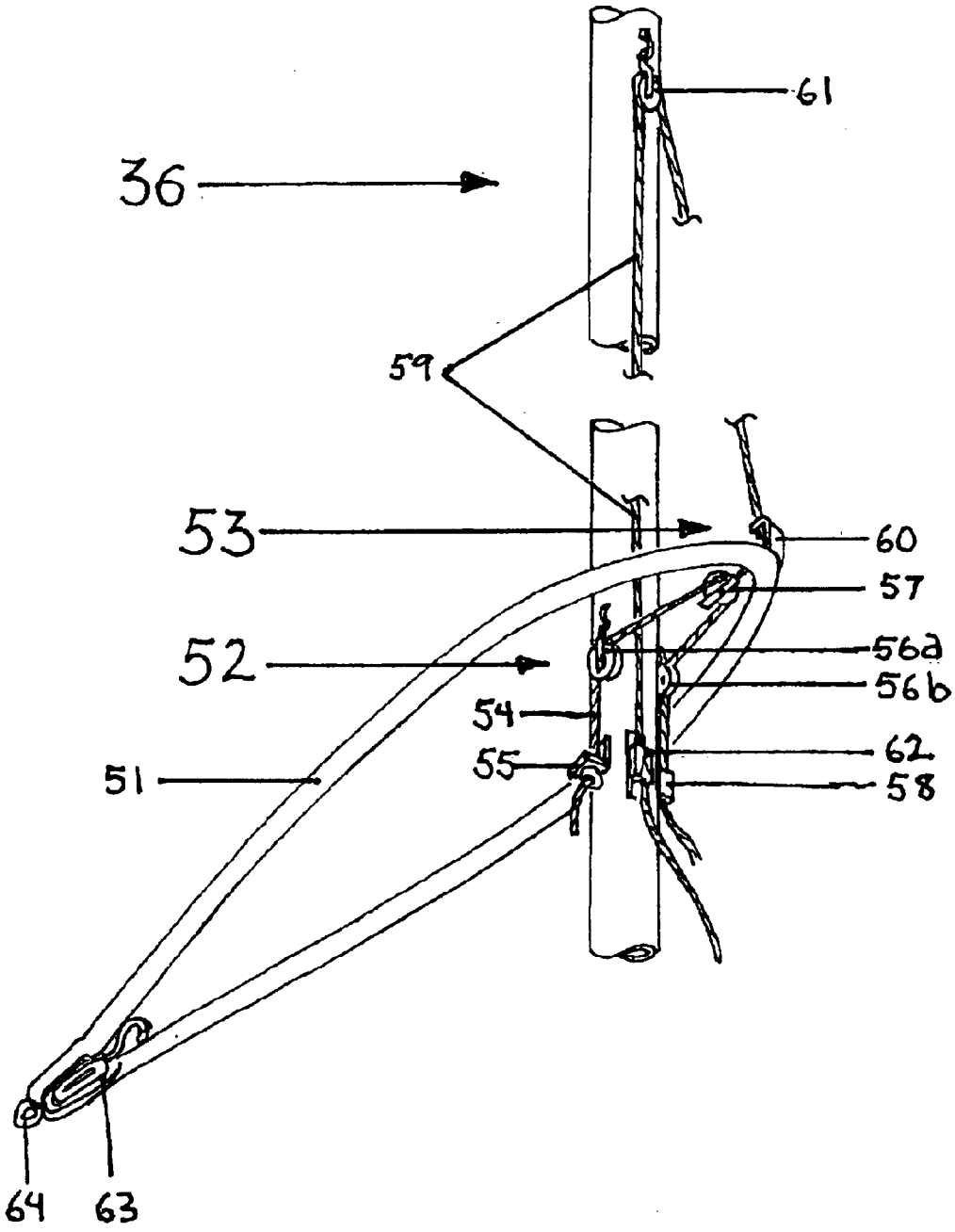
FIG. 8: a perspective view of a mast based sail management system

FIG. 8 shows the mast based sail management system that is made up of a wishbone boom 51, the outhaul system 52, and the boom stowage system 53. The wishbone boom 51 fits over the mast 36 but under the cable spreader cables FIG. 5, 42(*a,b,c*).

The Outhaul System FIG. 8, 52

The outhaul system 52 is designed to create a floating boom that will function without cables to the deck. At the front end and on the inside of the floating boom 51 is the outhaul boom pulley 57. Attached to opposite sides of the mast are the outhaul mast pulleys 56*a* and 56*b*. Below the outhaul mast pulleys 56*a* and 56*b* are the outhaul sheet stop cleat 55 and, on the other side of the mast, the outhaul sheet jam cleat 58. The outhaul sheet 54 is knotted at one end and threaded through the outhaul sheet stop cleat 55 until the knot rests against the cleat 55. The outhaul sheet 54 is then threaded through the outhaul mast pulley 56*b* directly above the outhaul sheet stop cleat 55. It is then threaded through the outhaul boom pulley 57 inside the front of the wishbone boom 51. Then the outhaul sheet 54 is threaded through the outhaul mast pulley 56*a* and through the outhaul sheet jam cleat 58 where the sheet is fixed. Pulling down on the outhaul sheet 54 pulls the front of the wishbone boom 51 toward the mast and pushes the end of the boom with the sail clew and boom vang retainer hook 63 and the point of sail eyelet 64 away from the mast 36. The boom floats in the sense that it is attached to the mast by lines and pulleys only.

The Boom Stowage System FIG. 8, 53

The boom stowage system 53 is designed to allow the sail and boom to be stowed to the mast in such a way that the boom can float keeping the deck free of lines.

The boom stowage pulley 61 is fixed towards the top front of the mast assembly 36 at a point below the top cable attaching points FIG. 5, 44(*a,b,c*), but at a distance above the outhaul mast pulleys 56*a* and 56*b* that is greater than the length of the boom 51. On the top front of the wishbone boom FIG. 8, 51 is fixed the boom stowage sheet stop cleat 60. Fixed to the mast assembly 36 directly below the boom stowage pulley 61 level with the outhaul sheet stop cleat 55 and the outhaul sheet jam cleat 58 is fixed the boom stowage jam cleat 62. One end of the boom stowage sheet 59 is knotted and the sheet is threaded through the boom stowage sheet stop cleat 60 until the knot rests against the cleat. It is then threaded through the boom stowage pulley 61 and back down the mast to the boom stowage jam cleat 62 where it is fixed. When the outhaul sheet 54 is released from the outhaul sheet jam cleat 58 and the boom stowage sheet 59 is pulled down, the front of the boom 51 is pulled up the mast 36. At the same time, the back of the boom attached to the sail by the sail clew and boom vang retainer hook 63 is pulled to the mast 36 collapsing the sail and making it ready to be bound to the mast 36 for stowage.

Figure 9:
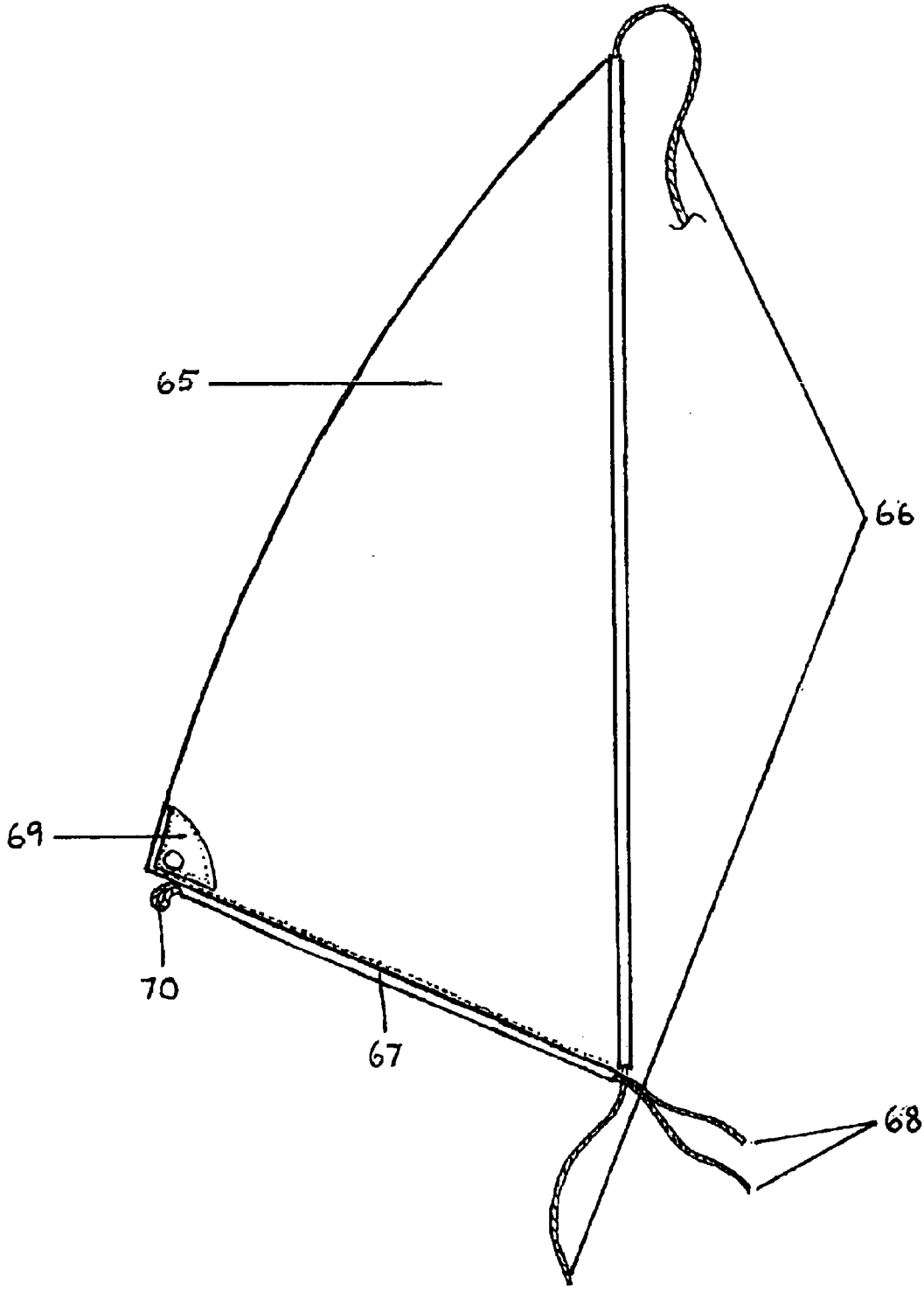
FIG. 9: a view of a sail modified for this system and method of reducing sailboat heeling

FIG. 9 shows the modified sail 65 necessary for this system and method for eliminating sailboat heeling. The bottom edge of the sail 65 is cut away upward from the front edge. This allows the floating wishbone boom FIG. 8, 51 to work above the heads of sailors on the deck. The front edge of the sail 65 has a sleeve sewn into it and the sail halyard 66 is threaded through that sleeve. The bottom edge of the sail 65 has the boom vang sleeve 67 sewn into it. The boom vang 68 is a line that is threaded doubled through the boom vang sleeve 67 so that a boom vang loop 70 is available just under the sail clew 69. The sail clew 69 and boom vang loop 70 are threaded onto the sail clew and boom vang retainer hook FIG. 8, 63. When the outhaul sheet FIG. 8, 54 is pulled down, the end of the floating wishbone boom FIG. 8, 51 with the sail clew and boom vang retainer hook FIG. 8, 63 attached to the sail clew FIG. 9, 69 and the boom vang loop 70 is pushed away from the mast assembly FIG. 5, 36 spreading the sail 65 tight. The boom vang ends 68 are tied off to the mast FIG. 5, 36.

I claim:

1. a system and method of reducing or eliminating sailboat heeling comprising:

a sailboat with a hull and deck within which is integrated a support cross member, a housing attached to the cross member comprising a pivot ball and retainer ring, a mast support tube comprising a tube with a ball socket joint on one end that fits the pivot ball of the housing, a thrust wear button that fits inside the mast support tube upon which the mast can sit and rotate, a tensioning tube that fits over the mast support tube, a tensioning plate that is attached to the tensioning tube, tensioning devices that attach the tensioning plate to the retainer ring in the housing, a tensioning adjustor that can raise or lower the tensioning plate, a mast that is self stayed so that it can tilt freely with the mast support tube, a mast that is reinforced at the base to prevent it from bending between the bridged part of the mast and the mast support tube, a mast that has wear collars and a wear tube at the base that allows it to turn freely in the mast support tube, a sail management system that, excepting a point of sail sheet, frees the sail and boom of all lines to the deck that would hinder the tilting of the mast independently of the hull and deck, a sail that is cut upward away from the mast comprising a sleeve that holds a doubled line that is the boom vang and a sail clew at the outer end of the boom vang sleeve, a boom vang that is a line doubled in the boom vang sleeve of the sail allowing a boom vang loop to extend out of the sleeve just below the sail clew.

2. The support cross member in claim 1, comprising a cross member housing support ring that allows the housing to be placed partially below deck.

3. The tensioning device of claim 1, comprising an elastic boot attached at the top to the tensioning plate and at the bottom to the retainer ring in the housing.

4. The tensioning device of claim 1, comprising shock chords that attach at the top to the tensioning plate and at the bottom to the retainer ring in the housing.

5. The tensioning device of claim 1, comprising springs that attach at the top to the tensioning plate and at the bottom to the retainer ring in the housing.

6. The tensioning adjustor of claim 1 comprising a jacking device to raise or lower the tensioning plate.

7. The tensioning adjustor of claim 1 comprising turnbuckles or other adjustment devices on the tensioning devices to adjust the tension.

8. The self-stayed mast of claim 1 comprising a cable bridging system.

9. The cable bridging system of claim 8 comprising:

a split mast further comprising:

a mast divided half way along its length, a three way cable spreader splice, a three way cable spreader, cables that are attached at the top of the mast, thread through cable guides in the cable spreader and attached at the bottom of the mast, turnbuckles on each cable to adjust the tension on the cables.

10. The three way cable spreader of claim 9 comprising:

a hub that is fixed to the mast, three arms each 120 degrees from the others, cable guides at the end of each arm.

11. The sail management system of claim 1 comprising:

a system of pulleys, cleats and lines that attach a wishbone boom to the mast, a wishbone boom with a sail clew and boom vang retainer hook at its narrow or back end, a wishbone boom with a point of sail eyelet affixed to the narrow or back end a system of a pulley, cleats and a line that allow the use of a wishbone boom to stow the sail to the mast.

12. The system of pulleys, cleats and lines that attach a wishbone boom to the mast of claim 11 comprising:

an outhaul sheet stop cleat attached to the mast level with and opposite an outhaul jam cleat attached to the mast, an outhaul mast pulley attached to the mast above the outhaul sheet stop cleat, an outhaul mast pulley attached to the mast above the outhaul jam cleat, an outhaul boom pulley affixed to the inside of the front end of the wishbone boom, a line, the outhaul sheet, affixed to the outhaul sheet stop cleat and threaded through the outhaul mast pulley above the outhaul sheet stop cleat, then threaded through the outhaul boom pulley, then threaded through the outhaul mast pulley above the outhaul jam cleat and then tied off to the outhaul jam cleat, when the line is released from the outhaul jam cleat and pulled down, the front of the wishbone boom is pulled to the mast and the back of the wishbone boom with the sail clew and boom vang retainer hook is pushed away from the mast.

13. The sail clew and boom vang retainer hook of claim 11 that is large enough to attach the boom vang loop and sail clew of claim 1 to the back or narrow end of the wishbone boom.

14. The system of a pulley, cleats and a line that allow the sail and wishbone boom to be furled to the mast of claim 11 comprising:

a boom stowage sheet stop cleat attached to the top front of the wishbone boom, a boom stowage pulley attached to the front of the mast above the outhaul mast pulleys at a distance greater than the length of the wishbone boom, a boom stowage jam cleat attached to the front of the mast level with the outhaul sheet stop cleat and the outhaul jam cleat, a line, the boom stowage sheet, attached to the boom stowage sheet stop cleat, then threaded through the boom stowage pulley and back down to the boom stowage jam cleat. When the outhaul sheet is released and the boom stowage sheet is pulled downward, the front of the boom is lifted up the mast and the back of the boom with the sail attached is drawn to the mast for furling.

* * * * *